US006726499B1

(12) United States Patent
Yu

(10) Patent No.: US 6,726,499 B1
(45) Date of Patent: Apr. 27, 2004

(54) ELECTRICAL CONNECTOR HAVING IMPROVED TERMINALS

(75) Inventor: Hung-Chi Yu, Tu-Chen (TW)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/426,826

(22) Filed: Apr. 29, 2003

(30) Foreign Application Priority Data

Jan. 29, 2003 (TW) ..... 92201633 U

(51) Int. Cl.[7] ..... H01R 13/62
(52) U.S. Cl. ..... 439/328; 439/326; 439/636
(58) Field of Search ..... 439/326–328, 439/329, 631–637

(56) References Cited

U.S. PATENT DOCUMENTS 5,051,099 A * 9/1991 Pickles et al. ..... 439/108
5,759,057 A * 6/1998 Cheng et al. ..... 439/328
5,839,913 A * 11/1998 Fumikura ..... 439/326
5,938,463 A * 8/1999 Yodogawa ..... 439/326
6,126,472 A * 10/2000 Choy ..... 439/328
6,227,877 B1 5/2001 Mou et al.

* cited by examiner

*Primary Examiner*—Hien Vu
(74) *Attorney, Agent, or Firm*—Wei Te Chung

(57) ABSTRACT

An electrical connector (1) includes a dielectric housing (10) and a number of upper and lower terminals (20, 30). The dielectric housing defines a slot (15) extending in a longitudinal direction thereof and a number of upper and lower passageways (16, 17) communicating with the slot. The upper and lower terminals are respectively received in the upper and lower passageways. Each of the upper and lower terminals includes a mounting plate (21, 31), a resilient arm (22, 32) extending from the mounting plate for electrically connecting with an electronic card, a solder tail (25, 35) extending from the mounting plate for electrically connecting to the PCB, and upper and lower retaining portions (23, 33, 24, 34) extending from the mounting plate in a same direction and are retained in the housing.

2 Claims, 5 Drawing Sheets

ELECTRICAL CONNECTOR HAVING IMPROVED TERMINALS

BACKGROUND OF THE INVENTION

1. Field of the Invention

The present invention relates to an electrical connector, and particularly to an electrical connector having a plurality of improved terminals.

2. Description of Related Art

Card edge connectors are widely used for electrically connecting an electronic card received therein to a printed circuit board (PCB) to which the card edge connector is mounted. In order to use every possible area of the PCB effectively, surface mounting technology is commonly utilized to mount the card edge connector on the PCB. U.S. Pat. No. 6,227,877, issued to Mou et al., discloses a surface mounting contact assembled to a card edge connector. The contact includes a mounting plate, an arm extending forwardly from the mounting plate for electrically connecting an electronic card, a horizontal retaining portion extending forwardly from the mounting plate into a slot of the card edge connector's housing, and a horizontal solder tail extending rearwardly from the mounting plate for being surface mounted on a printed circuit board. The retaining portion is formed with a barb interferentially engaged with the housing. However, since the contact has only one retaining portion interferentially retained in the housing, the contact is easy to loose from the housing. Furthermore, the contact easily distorts due to warpage of the housing. It may render that the solder tails of the contacts of the card edge connector are not coplanar with each other, thereby increasing the difficulty of mounting the card edge connector on the PCB.

Hence, an electrical connector with an improved terminal is desired to overcome the disadvantages and problems of the prior art.

SUMMARY OF THE INVENTION

An object of the present invention is to provide an electrical connector with a plurality of improved terminals reliably retained in a dielectric housing thereof, thereby ensuring solder tails of terminals thereof to be coplanar with each other.

To achieve the above object, an electrical connector in accordance with the present invention for being mounted on a printed circuit board (PCB) comprises a dielectric housing and a plurality of terminals. The dielectric housing comprises a first wall, a second wall, a slot between the first and second walls and a plurality of passageways communicating with the slot. The second wall defines a first face exposed to the slot and a second face facing outwardly. The terminals are respectively received in corresponding passageways. Each of the terminals comprises a mounting plate, a resilient arm extending from the mounting plate, an first retaining portion and a second retaining portion extending respectively from the mounting plate in a same direction, and a solder tail extending from the mounting plate. The first and second retaining portions engage with the first and second faces of the second wall respectively.

Other objects, advantages and novel features of the invention will become more apparent from the following detailed description when taken in conjunction with the accompanying drawings.

DETAILED DESCRIPTION OF THE INVENTION

Figure 1:
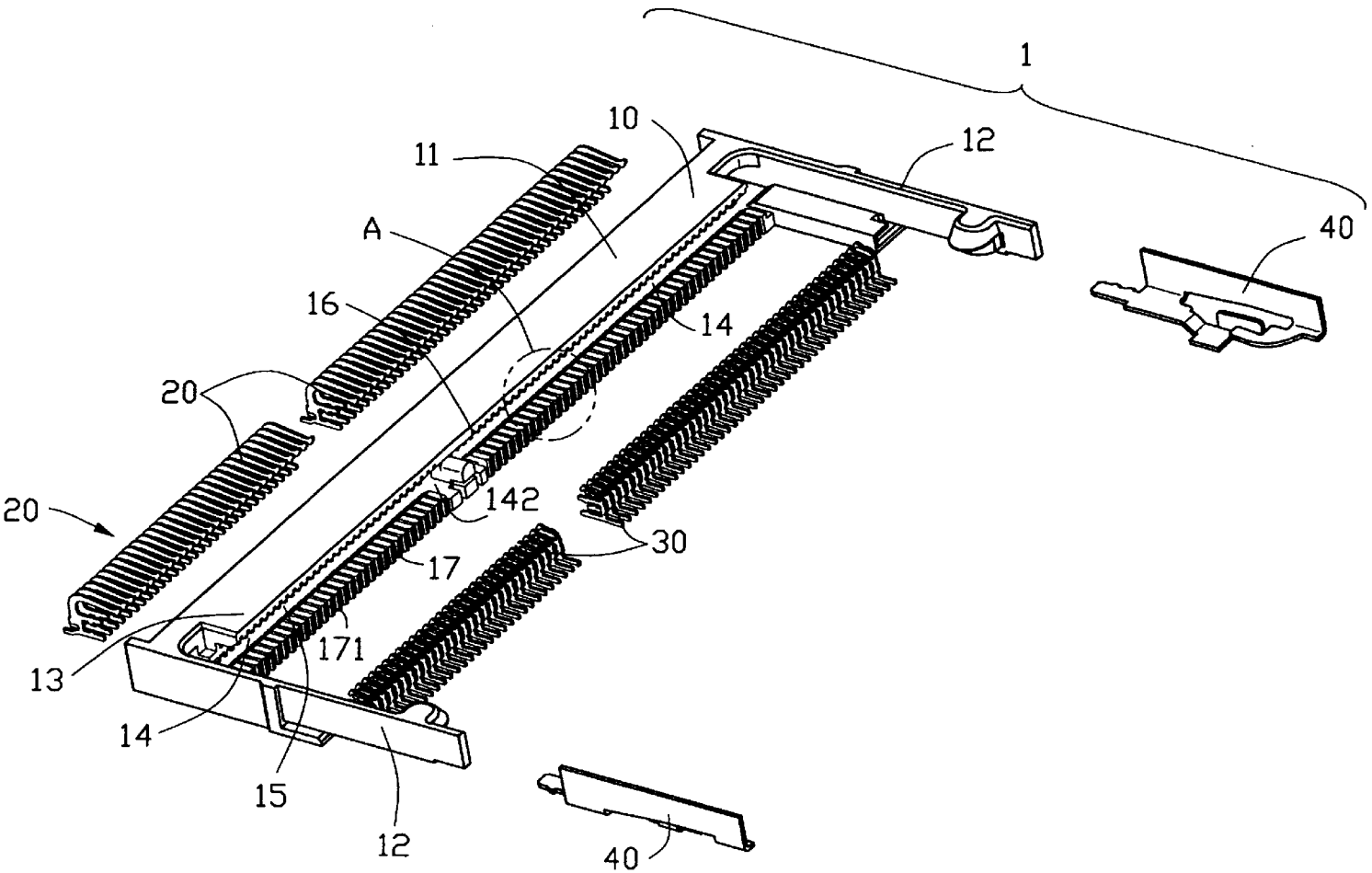
FIG. 1 is an exploded perspective view of an electrical connector in accordance with the present invention.
Figure 2:
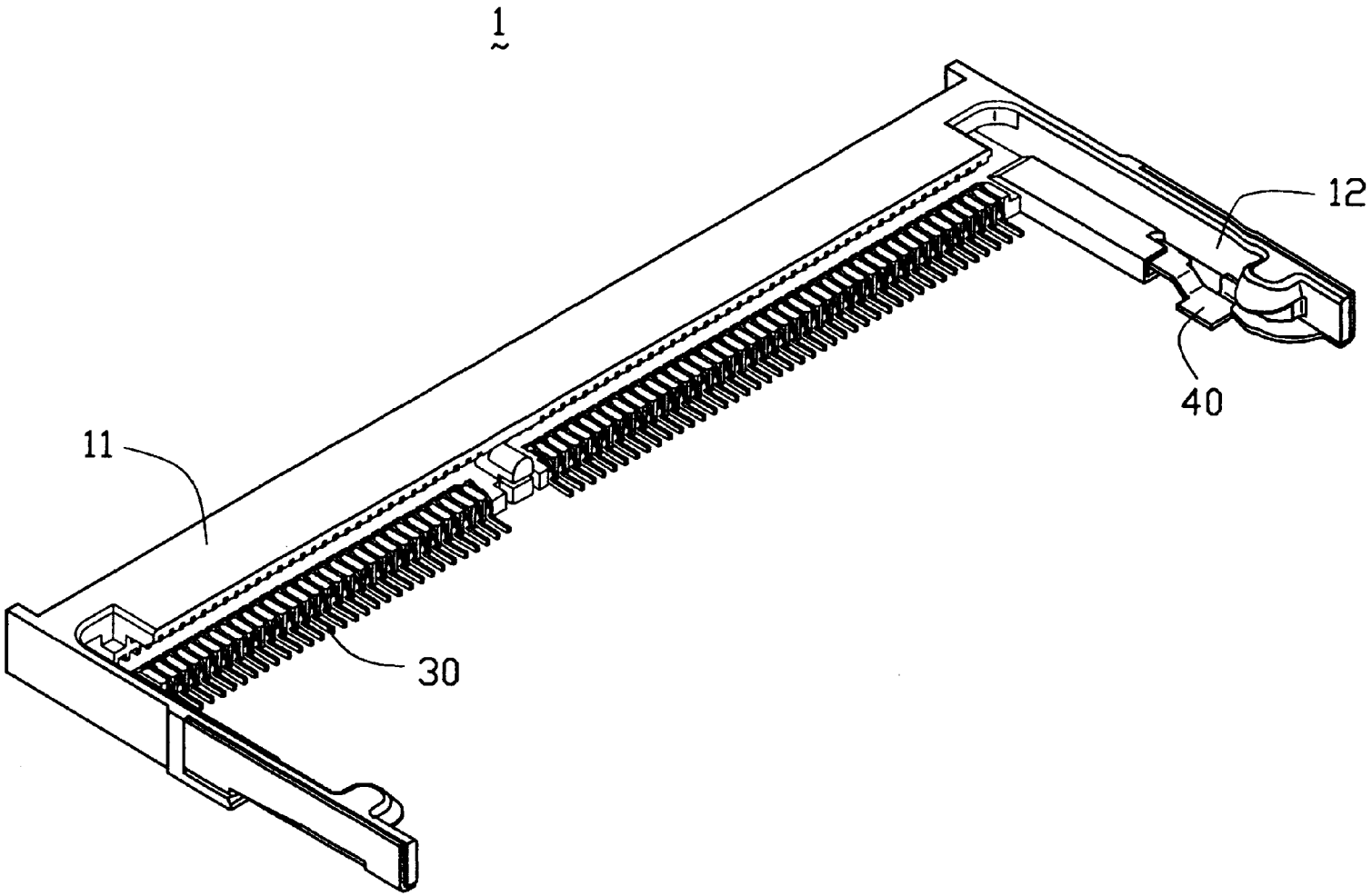
FIG. 2 is an assembled perspective view of the connector shown in FIG. 1.
Figure 3:
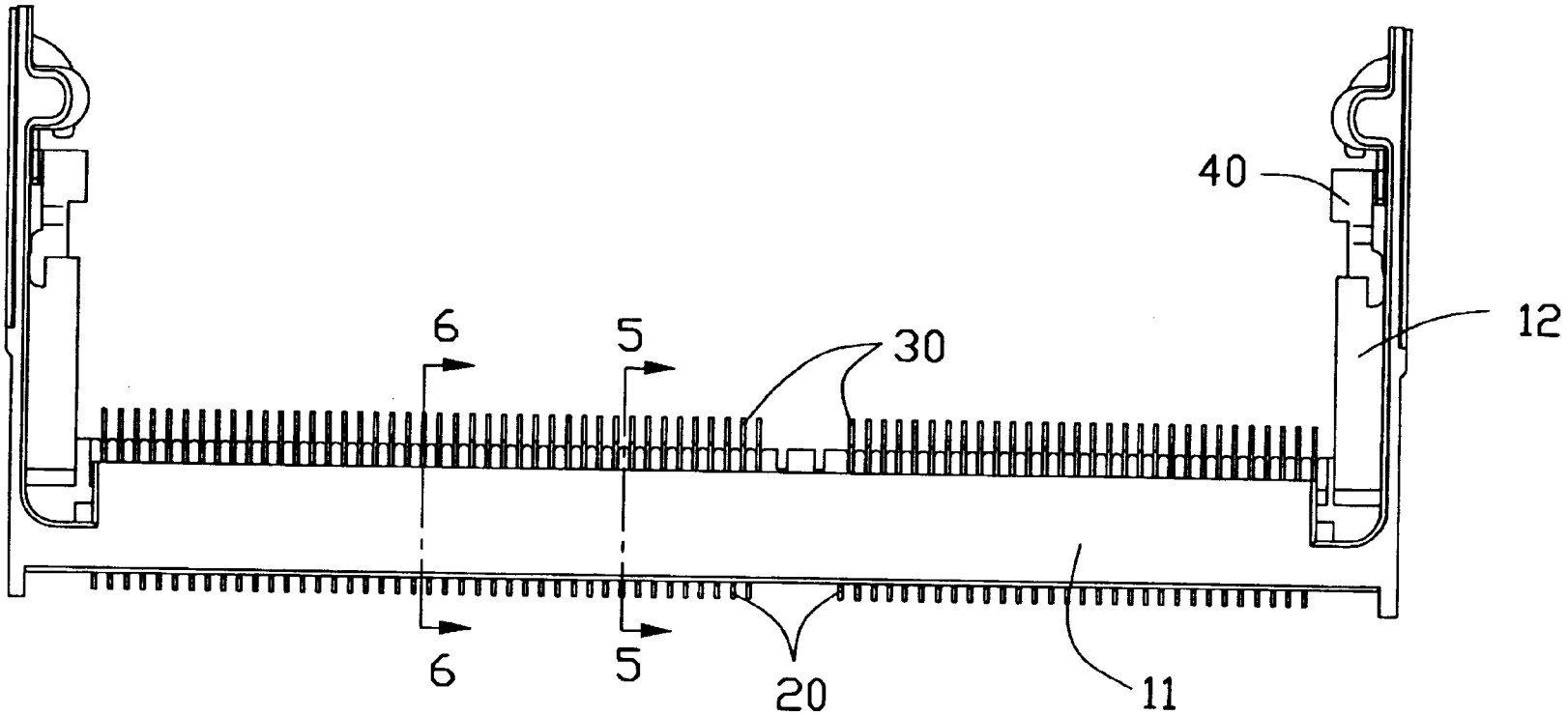
FIG. 3 is a top planar view of the connector of FIG. 2.
Figure 4:
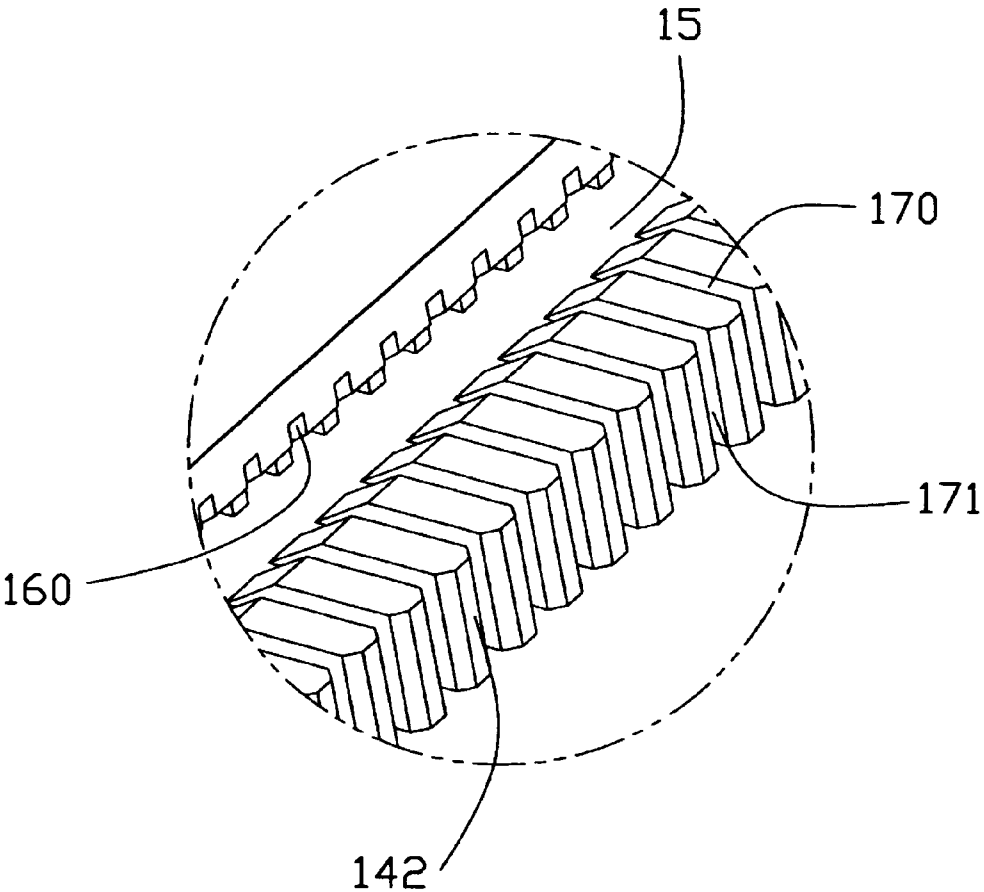
FIG. 4 is an enlarged perspective view taken from a circle A of FIG. 1.

Referring to FIGS. 1 and 2, an electrical connector 1 in accordance with the present invention comprises a dielectric housing 10, a plurality of upper and lower terminals 20, 30 respectively received in the dielectric housing 10, and a pair of metallic latches 40 attached to the housing 10.

Referring to FIGS. 3–6 in conjunction with FIGS. 1–2, the dielectric housing 10 comprises an elongated base 11 and a pair of guiding arms 12 extending forwardly from opposite longitudinal ends of the base 11 respectively. The latches 40 are fastened to the guiding arms 12 for enhancing the strength of the guiding arms 12. The base 11 comprises an upper and a lower wall 13, 14 defining a receiving slot 15 therebetween for receiving an electronic card (not shown) thereinto. The lower wall 14 has a top face 140 exposed to the slot 15, a bottom face 141 opposite the top face 140, and front and rear faces 142, 143 interconnecting the top and bottom faces 140, 141. A positioning post 18 is formed on the bottom face 141 for being received in a corresponding hole of the printed circuit board (PCB) (not shown) to accurately position the connector 1 on the PCB.

The dielectric housing 10 defines a plurality of upper and lower passageways 16, 17. Each of the upper and lower passageways 16, 17 comprises a channel 160, 170 communicating with the slot 15, a recess 161, 171 in the rear and front faces 143, 142 of the lower wall 14 communicating with the channel 160, 170 respectively, and a cutout 162, 172 at rear and front ends of the bottom face 141 of the lower wall 14 communicating with the recess 161, 171.

Figure 5:
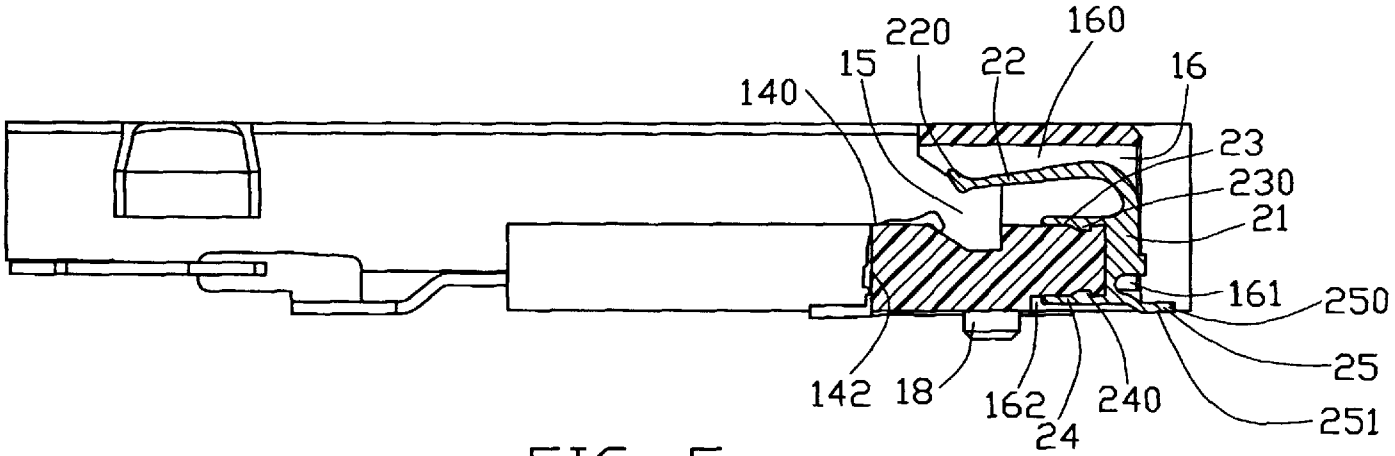
FIG. 5 is a cross-sectioned view taken along line 5—5 of FIG. 3.
Figure 6:
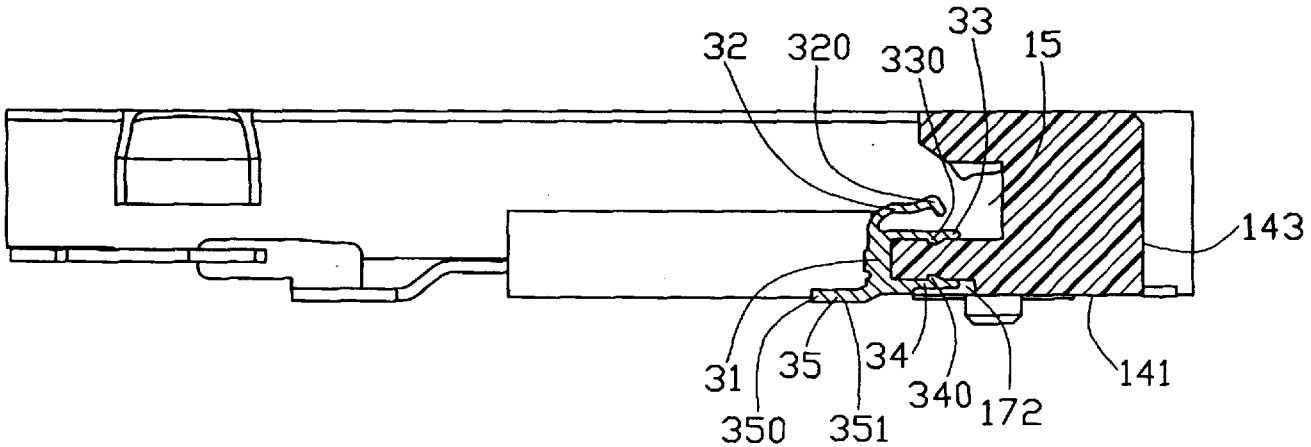
FIG. 6 is a cross-sectioned view taken along line 6—6 of FIG. 3.

Referring to FIGS. 5–6, the upper and lower terminals 20, 30 are respectively inserted into the corresponding upper and lower passageways 16, 17 of the housing 10. Each of the upper and lower terminals 20, 30 comprises a mounting plate 21, 31 received in the corresponding recess 161, 171, a resilient arm 22, 32 extending upwardly and slantedly from a top of the mounting plate 21, 31 to be received in the corresponding channel 160, 170 and partially extending into the slot 15, an upper retaining portion 23, 33 extending substantially perpendicularly from the top of the mounting plate 21, 31 to be received in the corresponding channel 160, 170, a lower retaining portion 24, 34 extending substantially perpendicularly from a bottom of the mounting plate 21, 31 to be received in the corresponding cutout 162, 172, and a solder tail 25, 35 extending oppositedly from the bottom of the mounting plate 21, 31 for being surface mounted to the printed circuit board. Each of the resilient arms 22, 32 is formed with a curved contacting portion 220, 320 projecting into the slot 15 for electrically contacting with corresponding golden fingers formed the electronic card. Each of the upper and lower retaining portions 23, 33, 24, 34 is formed with a barb 230, 330, 240, 340 on an inner side thereof engaging with the lower wall 14. Each of the solder tails 25, 35 is formed with a horizontal portion 250, 350 at a free end thereof. Each horizontal portion 250, 350 has a planar face 251, 351, and all the planar faces 251, 351 of the upper and lower terminals 20, 30 are coplanar. The terminals employs an additional retaining portion for increasing retention force between the upper and lower terminals 20, 30 and the housing 10 by contrast with the contact of the prior art, whereby the upper and lower terminals 20, 30 are reliably retained in the corresponding passageways 16, 17. The planar faces 251, 351 of the solder tails 25, 35 are ensured to be coplanar with each other to facilitate for the connector 1 surface mounted onto the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a first wall and a second wall, a slot between the first and second walls and a plurality of passageways communicating with the slot, the second wall defining a first face exposed to the slot and a second face facing outwardly; and a plurality of terminals respectively received in the passageways, each of the terminals comprising a mounting plate, a resilient arm extending from the mounting plate, a first retaining portion and a second retaining portion formed and extending respectively from the mounting plate in a same direction, and a solder tail extending from the mounting plate, the first and second retaining portions engaging with the first and second faces of the second wall respectively; wherein the first and second retaining portions extend substantially perpendicularly from the mounting plate, respectively, wherein the solder tail is formed with a horizontal portion having a planar face at a free end thereof, the planar faces of the terminals are coplanar with each other; wherein each of the passageways comprises a channel communicating with the slot and a cutout in the second face of the second wall, and wherein the first retaining potions of the terminals are respectively received in corresponding channels and the second retaining portions of the terminals are respectively received in corresponding cutouts; wherein each of the first and the second retaining portions is formed with a barb engaging with the second wall.

2. The electrical connector as claimed in claim 1, wherein the resilient arms of the terminals are respectively received in corresponding channels.

* * * * *